United States Patent [19]

Riesen

[11] Patent Number: 5,031,671

[45] Date of Patent: Jul. 16, 1991

[54] WEFT YARN CHANGER FOR A LOOM

[75] Inventor: Peter Riesen, Elgg, Switzerland

[73] Assignee: Sulzer Brothers Limited, Winterthur, Switzerland

[21] Appl. No.: 548,018

[22] Filed: Jul. 5, 1990

[30] Foreign Application Priority Data

Jul. 21, 1989 [CH] Switzerland ..... 02737/89

[51] Int. Cl.[5] ..... D03D 47/38

[52] U.S. Cl. ..... 139/453

[58] Field of Search ..... 139/453, 439

[56] References Cited

U.S. PATENT DOCUMENTS 4,781,226 11/1988 Moeneclaey et al. ..... 139/453

4,936,355 6/1990 Jankovsky ..... 139/453

FOREIGN PATENT DOCUMENTS 3716124 7/1988 Fed. Rep. of Germany .

*Primary Examiner*—Andrew M. Falik

*Attorney, Agent, or Firm*—Kenyon & Kenyon

[57] ABSTRACT

The weft yarn changer includes a multi-pivot transmission which is driven by a thrust rod. In addition, the thrust rod is driven by a rocking lever which can be coupled and uncoupled from the thrust rod by an actuating element in the form of a double-acting solenoid. When a weft change is to the effected, the solenoid actuates a tappet to deflect the thrust rod laterally so that a pin on the rocking lever engages in a bore of the thrust rod in order to couple the thrust rod to the rocking lever for a subsequent actuating motion.

9 Claims, 3 Drawing Sheets

WEFT YARN CHANGER FOR A LOOM

This invention relates to a weft yarn changer for a loom.

Heretofore, various types of weft yarn changers have been known for the changing of weft yarns in looms. For example, German Patent Application 3716124 Cl describes a weft yarn changer which enables various weft yarns to be presented at choice to a picking element, the changer being embodied by a multi-pivot device in which a drive member can be coupled with a driven member by an actuating element in accordance with a program. As described, a cam motion moves a lever mechanism monotonously from one end position to another end position with interim inoperative pauses being observed in each case during a working cycle. During these pauses, the drive and driven members can be rigidly interconnected as a result of an electro-magnet moving a drive pin into a groove disposed on a drive element for a yarn feeder. However, the electro-magnets which are necessary for changing are disposed on the drive and/or driven members and must always be moved therewith. As a result, there is an increase in overall weight of the overloaded and constantly moving multi-pivot device.

Accordingly, it is an object of the invention to reduce the number of continuously moving parts in a weft yarn changer.

It is another object of the invention to provide a very simple and lightweight weft yarn changer.

It is another object to the invention to provide a minimum of moving parts to initiate changing within a weft yarn changer for a loom.

It is another object to the invention to reduce wear in a weft yarn changer.

Briefly, the invention provide a weft yarn changer which includes a thrust rod which is mounted for movement in a longitudinal direction between a rest position and an actuating position in order to effect a weft yarn change, for example, via a suitable multi-pivot transmission or linkage. In addition, a rocking lever is mounted for movement between a rest position and an actuating position while an actuating element is connected to the thrust rod for selectively moving a part of the thrust rod laterally of the longitudinal direction from an inoperative position to an operative position in order to engage the thrust rod with the lever for subsequent moving of the rod with the lever to the in order to effect a weft yarn change.

With this construction, a pivot point of the thrust rod is directly movable at choice into and out of engagement with an associated pivot point of the rocking lever. When the two pivot points are interconnected, the thrust rod is in the operative position but, at other times, the thrust rod is in an inoperative or normal position. In a preferred embodiment, the thrust rod is formed with a bore representing the pivot point thereof while the rocking lever has a pin adapted to the bore in order to serve as a pivot point. The pin engages in the bore for weft yarn changing.

The actuating means may be embodied by a solenoid having a reciprocally mounted tappet for producing a programmed transverse movement of the thrust rod. The tappet may also be provided with a pair of shoulders for engaging opposite sides of the thrust rod. In this respect, the thrust rod is provided with a slot at one end to slidably receive the tappet.

The weft yarn changer may also be provided with a stationery locking element for registration with a bore in the thrust rod when the thrust rod is in the inoperative position in order to prevent longitudinal movement of the thrust rod.

The effect of the weft yarn changer is that a multi-pivot drive (transmission), except for the driving rocking lever, is moved only during the changing step. Pivot points of the multi-point drive (transmission) therefore experience little, if any, wear.

Since the solenoid for moving the rod laterally is stationary, positioning and electrical connections for the solenoid pose no problem. Further, the changer is of simple construction, has few moving parts and can be controlled accurately during changing. The thrust rod can be coupled and uncoupled from the rocking lever very accurately by the solenoid.

These and other objects and advantages of the invention will become more apparent from the following detailed description taken in conjunction with the accompanying drawings wherein.

Figure 1:
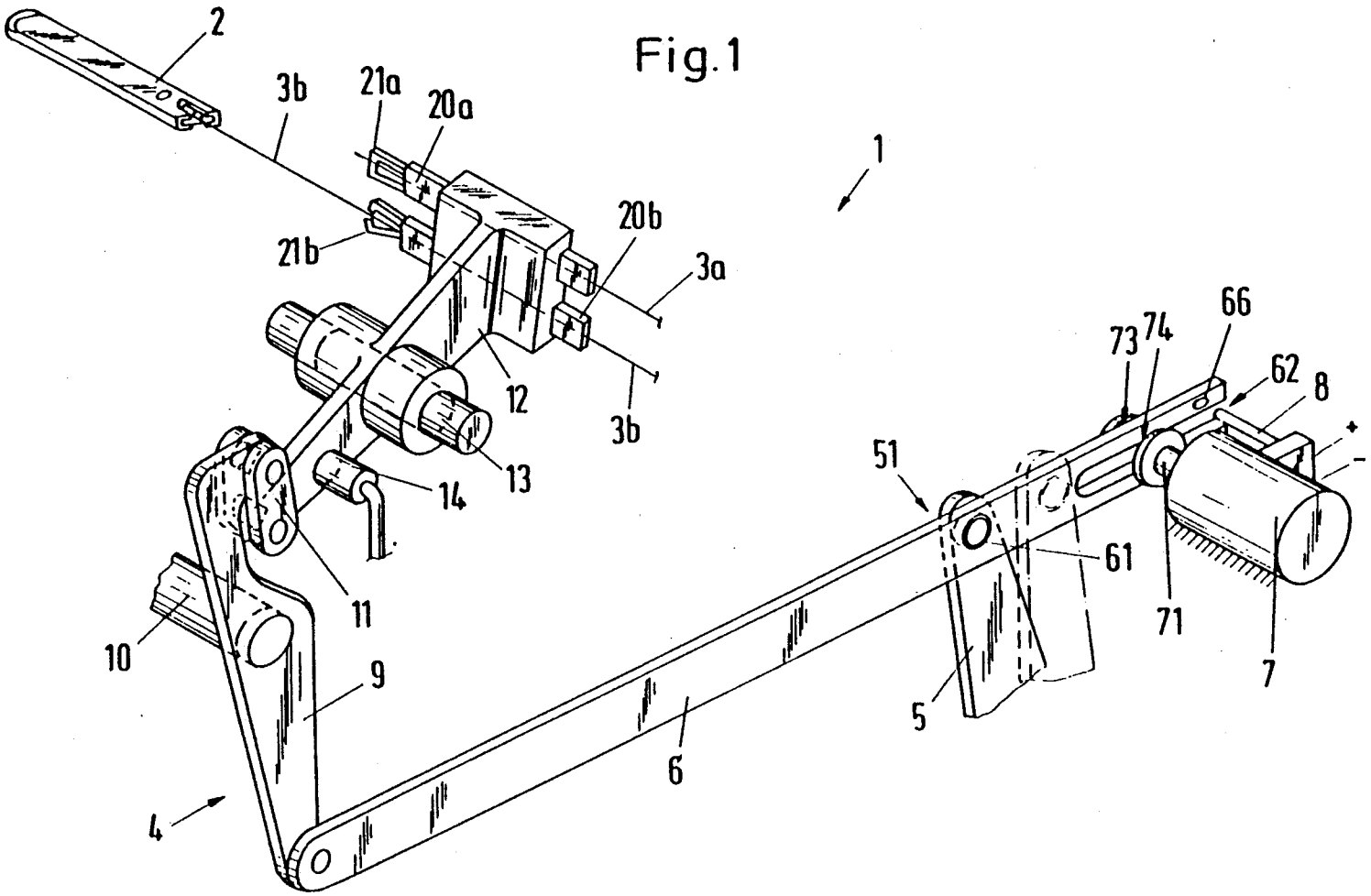
FIG. 1 illustrates a perspective view of a weft yarn changer constructed in accordance with the invention.

Referring to FIG. 1, the weft yarn changer 1 is of generally known construction and is used for directing one of at least two weft yarns to a projectile 2 in known fashion. As indicated, the weft yarn changer 1 has a transmission including a two-armed lever 9 which is pivotally mounted on a shaft 10, a pair of links 11 which are pivotally mounted on one end of the lever 9 and a changer segment 12 which is pivotally connected to the links 11 and pivotally mounted on a pivot shaft 13. As indicated, the segment 12 carries a pair of yarn givers 20*a*, 20*b*, each of which carries a gripper 21*a*, 21*b*, respectively. Each gripper 21*a*, 21*b*, in turn, holds a weft yarn, 3*a*, 3*b* which is to be directed to the projectile 2.

The transmission 4 which is made up of the lever 9, links 11 and changer 12 is actuated via a thrust rod 6 which is mounted for movement in a longitudinal direction between a rest position as shown in FIG. 1 to an actuating position (not shown) in order to effect a weft yarn change. In addition, a rocking lever 5 is provided for moving the thrust rod 6. This rocking lever 5 is pivotally mounted for movement between a rest position, shown in dotted line in FIG. 1, and an actuating position, as shown in solid line in FIG. 1. The locking lever 5 is also connected, for example, to a cam motion.

Referring to FIG. 1, an actuating element 7 is connected to the thrust rod 6 for selectively moving a part of the thrust rod 6 laterally of the longitudinal direction between an inoperative position (shown in dotted line in FIG. 2) and an operative position (shown in solid line in FIG. 2) in order to engage the rod 5 with the lever 6 for subsequent movement of the rod 6 with the lever 5 to the actuating positions thereof in order to effectuate a weft yarn change.

As illustrated, the thrust rod 6 has a bore 61 which defines a pivot point while the rocking lever 5 has a pin 51 which defines a pivot point for engaging in the bore 61 when the rod 6 is in the operative position.

Referring to FIG. 1, the actuating element 7 is in the form of a solenoid which has a reciprocally mounted tappet 71 engaged with the thrust rod 6. To this end, the thrust rod 6 is provided with an elongated slot 62 at one end in which the tappet 17 is slidably engaged. In addition, the tappet 71 has a pair of shoulders 73, 74 disposed on opposite sides of the thrust rod 6 to effect lateral movement of the thrust rod 6.

The thrust rod 6 is also provided with a second bore 66 near the end while a stationary locking element 8 is mounted to the side of the solenoid 7 so as to be in registration with the bore 66 in the inoperative position of the rod 6 in order to prevent longitudinal movement of the rod 6.

Figure 2:
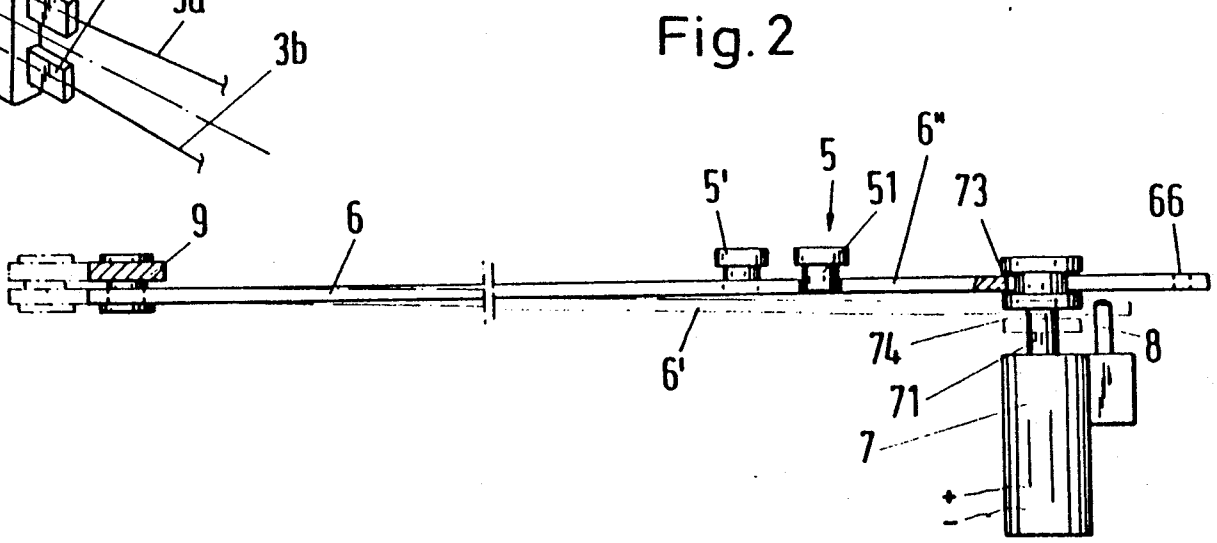
FIG. 2 illustrates a plan view of the thrust rod and actuating element of FIG. 1.

During a changing operation, the rocking lever 5 rocks from the front (actuating) position into the rear (rest) position and then back again into the front position. Thereafter, the rocking lever 5 remains stationary for the rest of the time of the weaving cycle. During this time, the solenoid 7 is actuated so as to engage or disengage the rocking lever 5 from the thrust rod 6. In this respect, the solenoid 7 picks up whenever the loom control outputs a pulse for a change of position. Whereupon, the tappet 71 moves out of the solenoid (as shown in FIG. 2) to connect the thrust rod 6 to the rocking lever 5 at the pivot points 51, 61 in the engagement part 60 of lever 5. As indicated in FIG. 2, when the thrust rod 6 is moved to the operative position by the tappet 71, the pin 51 on the rocking lever 5 is engaged in the bore of the thrust rod 6. As the thrust rod then is moved from the rear position to the front position, the thrust rod 6 is moved forwardly. As a result, the transmission 4 is activated to effect a weft change.

With the transmission 4 in the position shown in FIG. 1, the segment 12 is in a top position with the yarn giver **20*b* in a picking position. The gripper 21*b* of the giver 20*b* is in an open state and the projectile (picking element) is clamping a weft yarn 3*b*** for picking into a loom.

As illustrated, a sensor 14 is provided to sense the position of the segment 12, for example, the bottom position illustrated. In this respect, the sensor 14 is used to detect whether or not the segment 12 is correctly positioned. If the sensor is not correctly positioned, the loom control would override the control program for the solenoid 7 and cause the solenoid 7 to actuated the tappet 71 in order to correct the position of the segment 12 in the next reciprocation of the rocking lever 5.

Referring to FIG. 2, the thrust rod 6 is shown in the solid line position during changing. In this respect, the tappet 71 has moved out of the solenoid 7, the locking element 8 has moved out of engagement with the bore 66 and the thrust rod has been moved into the position 6″ and engages with the rocking lever pin 51. After the lever 5 finishes movement into the front position 5″, the tappet 71 returns into the solenoid 7, the shoulder 73 moving the thrust rod 6 into the inoperative position 6″. The locking element 8 is then moved into registration with the bore 66.

While the shoulder 73 of the tappet 71 alters the position Of the thrust rod 6 from the operative position to the inoperative position, the second shoulder 74 presses the thrust rod 6 into the operative position. That zone of the tappet 71 which lies between the shoulders 73, 74 is effective for coarse guidance of the thrust rod 6, for example, during assembly.

Figure 3:
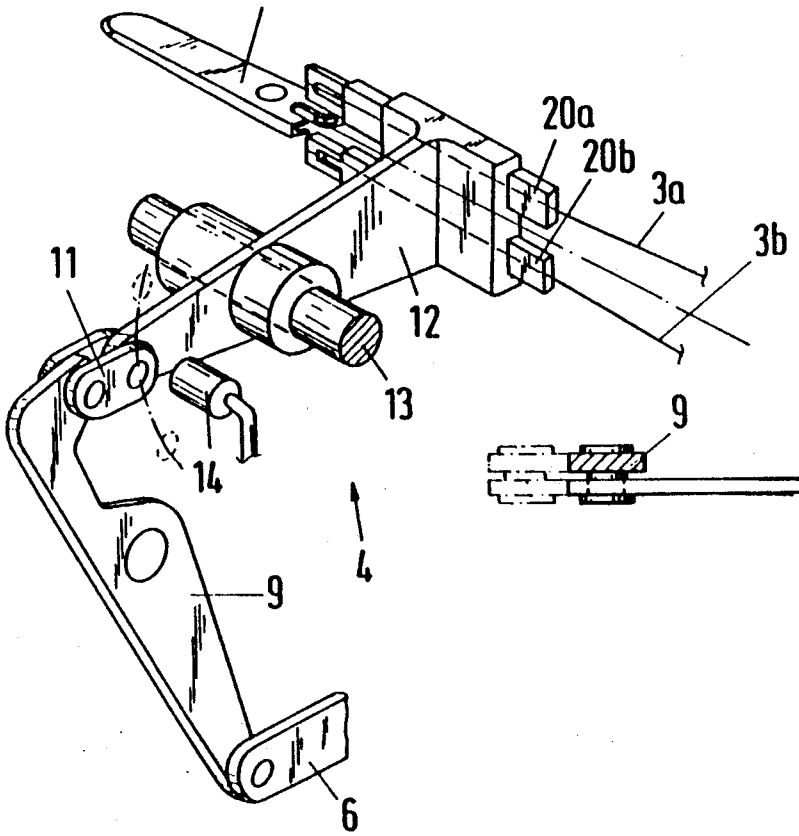
FIG. 3 illustrates a perspective partial view of the changer of FIG. 1 in an intermediate position during changing.

Referring to FIG. 3, during changing, the transmission 4 takes up a position in which the link pair 11 is disposed as a prolongation of the segment 12. In addition, the projectile 2 is disposed exactly between the two yarn givers **20*a*, 20*b***.

Figure 4:
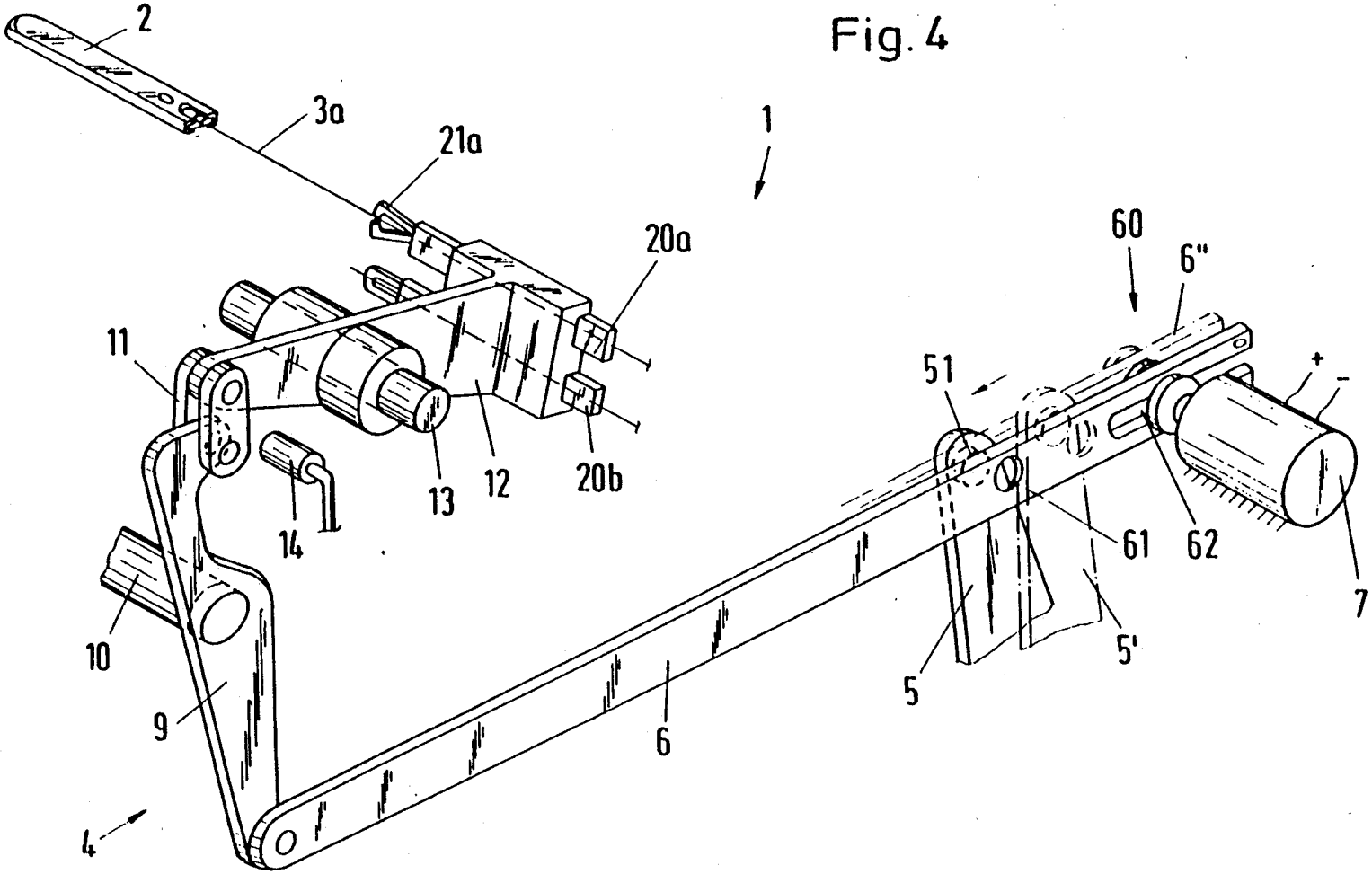
FIG. 4 illustrates a view similar to FIG. 1 with the changer in a different position and with the thrust rod in an inoperative position.

Referring to FIG. 4, at the conclusion of a step of changing from one weft yarn **3*b* to another weft yarn 3*a*, the rocking lever 5 has returned to the inoperative position at the pivot point 51 in the direction indicated by the arrow and the lever 9 has been so pivoted clockwise that the link pair 11 is once again in the vertical position in which the links keep the changer segment 12 depressed as is known. In this case, the weft yarn 3*a* can be transferred to the projectile 2 while the gripper 21*a* is opened in order to release the weft yarn 3*a*. On note, the sensor 14 does not detect the presence of the segment 12** in this position.

As also indicated in FIG. 4, before beginning the next working stroke by the rocking lever 5, the solenoid 7 moves the thrust rod 6 from the chained-dotted position 6″ into the solid line position 6.

As described with respect to FIG. 1, the solenoid 7 picks up only when a change in the position of the changer segment 12 is intended. The loom program therefore provides that, in the event of disturbances, such as weft or warp yarn breakages, the transmission of pulses to the solenoid 7 is suppressed. Even when the loom is being inched, there must be no coupling of the rocking lever 5 with the thrust rod 6. If this is otherwise, the link pair 11 might not overcome the extended position shown in FIG. 3 possibly leading to cessation of the mixing and changing function of the weft yarn changer and, possibly, even to the changer being damaged.

The invention must provide a weft yarn changer of relatively simple instruction. In particular, the invention provides a weft yarn changer of limited weight.

Further, the invention provides a weft yarn changer in which the number of continuously moving parts is limited to a small number. Further, when a weft yarn change is not required, a substantial number of elements of the weft yarn changer transmission need not be moved. As a consequence, the pivot points of the transmission experience little, if any wear.

What is claimed is:

1. A weft yarn changer comprising a thrust rod mounted for movement in a longitudinal direction between a rest position and an actuating position to effect a weft yarn change;

a rocking lever mounted for movement between a rest position and a actuating position; and an actuating element connected to said thrust rod for selectively moving a part of said thrust rod laterally of said longitudinal direction from an inoperative to an operative position to engage said rod with said lever for subsequent movement of said rod with said lever to effect a weft yarn change.

2. A weft yarn changer as set forth in claim 1 wherein said thrust rod has a bore and said lever has a pin for engaging in said bore in said operative position of said thrust rod.

3. A weft yarn changer as set forth in claim 2 wherein said actuating element includes a solenoid having a reciprocally mounted tappet engaged with said thrust rod.

4. A weft yarn changer as set forth in claim 3 wherein said rod has a slot at one end slidably receiving said tappet and said tappet has a pair of shoulders engaging opposite sides of said rod.

5. A weft yarn changer as set forth in claim 2 wherein said bore is circular and said pin is of circular cross-section.

6. A weft yarn changer as set forth in claim 1 wherein said rod has a bore and which further comprises a stationary locking element in registration with said bore in said inoperative position of said rod to prevent longitudinal movement of said rod.

7. In a weft yarn changer, the combination comprising a thrust rod mounted for movement in a longitudinal direction between a rest position and an actuating position to affect a weft yarn change;

said thrust rod having a bore in an intermediate part;

a rocking lever pivotally mounted for movement between a rest position and an actuating position, said lever having a pin for selectively engaging in said bore in said thrust rod; and an actuating element connected to said rod for moving said part of said thrust laterally of said longitudinal direction inoperative position to an operative position engage said pin in said bore for movement said rod with said lever to affect a weft change.

8. The combination as set forth in claim 7 said rod has a slot at one end and said actuating element includes a tappet slid mounted in said slot and a solenoid for reciprocating said tappet to move said between said operative and said inoperative positions thereof.

9. The combination as set forth in claim 8 said rod has a bore and which further comprises a stationary locking element in registration with said bore in said inoperative position said rod to prevent longitudinal movement said rod.

* * * * *

UNITED STATES PATENT AND TRADEMARK OFFICE

CERTIFICATE OF CORRECTION

PATENT NO. : 5,031,671

DATED : July 16, 1991

INVENTOR(S) : PETER RIESEN

It is certified that error appears in the above-identified patent and that said Letters Patent is hereby corrected as shown below:

Column 1, line 49 after "to the" insert -actuating position-
Column 2, line 54 change "locking" to -rocking-
Column 3, line 46 change "actuated" to -actuate-
Column 3, line 61 change "Of" to -of-
Column 4, line 13 change "On" to -Of-
Column 4, line 34 change "must" to -thus-
Column 5, line 15 change "affect" to -effect-
Column 6, line 3 after "said" insert -thrust-
Column 6, line 4 after "thrust" insert -rod-
Column 6, line 5 after "direction" insert -from an-
Column 6, line 6 after "position" insert -to-
Column 6, line 6 after "movement" insert -of-
Column 6, line 7 change "affect" to -effect-
Column 6, line 7 after "weft" insert -yarn-
Column 6, line 8 after "7" insert -wherein-
Column 6, line 10 change "slid" to-slidably-
Column 6, line 11 after "said" (first occurrence) insert -rod-
Column 6, line 13 after "8" insert -wherein-
Column 6, line 16 before "said" (both occurrences) insert -of-
Column 4, line 34, change "provide" to --provides-- and "instruction" to --construction--.

Signed and Sealed this

Second Day of March, 1993

*Attest:*

STEPHEN G. KUNIN

*Attesting Officer*

*Acting Commissioner of Patents and Trademarks*